US006352116B1

(12) United States Patent
Børseth

(10) Patent No.: US 6,352,116 B1
(45) Date of Patent: Mar. 5, 2002

(54) RISER MOVING AND GUIDING USING SHUTTLE PLATES

(75) Inventor: Knut Børseth, Valhallaveien (NO)

(73) Assignee: Petroleum Geo-Services AS, Lysaker (NO)

( * ) Notice: Subject to any disclaimer, the term of this patent is extended or adjusted under 35 U.S.C. 154(b) by 0 days.

(21) Appl. No.: 09/141,474

(22) Filed: Aug. 29, 1998

(30) Foreign Application Priority Data

Jul. 17, 1998 (NO) ..... 98 3337

(51) Int. Cl.[7] ..... E21B 7/128
(52) U.S. Cl. ..... 166/359; 405/223.1; 405/196
(58) Field of Search ..... 405/223.1, 224, 405/224.1, 224.2, 224.3, 195.1, 196; 166/360, 350, 359, 367

(56) References Cited

U.S. PATENT DOCUMENTS 3,474,749 A * 10/1969 Williamson ..... 405/196
3,515,084 A * 6/1970 Holmes ..... 405/196
3,993,273 A 11/1976 Dade ..... 405/195
4,114,393 A * 9/1978 Engle et al. ..... 405/211
4,469,181 A * 9/1984 Kellett ..... 405/195.1
4,629,366 A * 12/1986 Rutherford ..... 405/211
4,784,529 A * 11/1988 Hunter ..... 405/227
5,421,676 A * 6/1995 Wybro et al. ..... 405/223.1
5,697,447 A 12/1997 Børseth ..... 405/224.3
5,707,178 A * 1/1998 Srinivasan ..... 405/223.1

* cited by examiner

*Primary Examiner*—Eileen D. Lillis
*Assistant Examiner*—John Kreck
(74) *Attorney, Agent, or Firm*—Arnold & Associates

(57) ABSTRACT

A riser tube tower for stabilizing riser tubes extending from respective wellheads associated with a seabed frame on the seabed to a platform, preferably a tension leg platform, at the sea surface. The riser tube tower includes vertical wires connecting the platform with the seabed frame. Horizontally disposed guide plates are fixed in position at one or more levels of the tower. Vertically movable shuttle plates are located in the vertical spaces over, between, and under the guide plates. The vertical wires and riser tubes pass through spaced apertures in the guide plates and the shuttle plates. The apertures in the shuttle plates are aligned with respective apertures in the guide plates. Bushings are disposed in the apertures of the guide plates and the shuttle plates for protecting the guide plates and shuttle plates from the riser tubes and wires, and for reducing friction therebetween. Elevator devices move the shuttle plates vertically above, below, or between the guide plates. The shuttle plates move between the platform and the seabed frame together with the riser tubes and guide the riser tubes to respective apertures in the guide plates, and to respective wellheads in the seabed frame.

11 Claims, 11 Drawing Sheets

30
60
60
30
sl
1
18
18
90
91
90
91
90
91
6A
91
16
82
82
9
91
9
9
8A
12
10
10
91
91
91
90
90
90
6B
3
3
82
82
9
91
9
91
9
8B
12
90
90
90
90
6C
91
91
91
3
3
16N
2
2400 mm

RISER MOVING AND GUIDING USING SHUTTLE PLATES

CROSS REFERENCE TO RELATED APPLICATIONS

Foreign priority benefit is claimed under 35 USC §119 (a)–(d) or §365(b) to Norway patent application number 98.3337, filed Jul. 17, 1998.

STATEMENT REGARDING FEDERALLY SPONSORED RESEARCH OR DEVELOPMENT

Not applicable.

BACKGROUND OF THE INVENTION

1. Field of the Invention

This application relates to riser tubes in connection with petroleum production in deep waters. More specifically, it relates to devices for stabilizing riser tubes, and devices and methods for installing riser tubes between a construction in the sea surface, and an installation on the seabed.

2. Description of the Related Art

Tension leg platforms (TLP) used in deep waters must have some distance between the riser tubes in order to avoid the riser tubes slamming against each other and to avoid the riser tubes becoming tangled up due to movements under varying vertical tension, and due to movements in horizontal sea currents and waves. This invention may be used in petroleum production for sea depths between about 500 meters and 2500 meters. The ordinary way of securing a sufficient separation between the riser tubes is to increase the tension of the riser tubes. A complementary method is to arrange the riser tubes with greater distance at the TLP and at the connection points at a seabed frame. During a deep water field development under heavy sea current conditions one of the considered alternatives was the application of a relatively light TLP with a riser tube separation of 2.4 meters. However, with the initial riser tube separation, there was a risk of the riser tubes touching each other, and the field operator demanded the riser separation be increased to 6.0 meters. This led to abandoning of the use of the initial light TLP, which had to be replaced by a larger TLP at a price six times more expensive, compared to the light platform.

A method to avoid touching between the riser tubes is to tighten them up by means of frames comprised of guide plates in the upper and lower parts of the riser tube tower. The guide plates comprise apertures or openings with fixed separations in the sideward direction, and arranged to be run through by riser tubes and tension legs or tension wires. In Petroleum Geoservices (PGS)' patent application PCT/NO/00047, an intermediate third frame or guide plate is arranged between the lower and the upper guide plate. This intermediate third guide plate is rotated about a vertical axis in order to tighten up the riser tubes in the sideward direction in a common rotation movement.

An alternative way of separating the riser tubes from each other is to arrange horizontal guide plates with even distance downward along the vertical tension legs and the vertical riser tubes. The horizontal guide plates may in addition be stabilized by wire stays to anchors, preferably suction anchors. First, the tension legs are installed between the seabed installation and the TLP. The guide plates may be arranged with the riser tubes drawn through the guide plates, and where the guide plates are at the outset in a position closely below the bottom of the TLP. One problem which will occur during the installation of riser tube towers of this kind is to hit with the riser tube when it shall be lowered through each guide plate, and additionally to hit the right holes in the guide plate, and to hit the right connection point at the seabed installation. One ordinarily used method is to apply a Remotely Operated Vehicle (ROV) to guide each single riser tube in the sideward direction at both the guide plates and on the seabed installation. However, it is time-consuming and operatively complicated to apply an ROV at such great water depths. Such ROVs are relatively slow, and the energy requirements for supplying energy from the surface to the cable connected ROV is reduced by voltage losses which increase with increasing cable length. The signal quality is also reduced with increasing cable length. A freely moving ROV (without umbilical cable) will be hampered by slow communication and with a signal quality which decreases with increasing operation depth.

BRIEF SUMMARY OF THE INVENTION

The solution to the above mentioned problems is a riser tube tower comprising vertical wire connections between a platform, preferably a tension leg platform at the sea surface and a seabed frame comprising one or more wellheads in deep water, with guide plates arranged at least in one level, with spaced apertures, through which apertures pass riser tubes and wires. The new and inventive concept of this invention is characterized by:

shuttle plates arranged in the vertical spaces between the guide plates, where the shuttle plates are provided with spaced apertures, through which apertures pass riser tubes and wires, and elevator devices arranged for vertical movements of the shuttle plates over, under, and between the guide plates, in such a way as to be vertically displaced together with the riser tubes to guide the riser tubes to the apertures of the guide plates, both between the platform and the seabed frame, and to the wellheads of the seabed frame.

The shuttle plates themselves may function as guide plates if the guide plates are not needed due to low current velocities or due to other circumstances. Thus the invention also comprises a riser tube tower comprising vertical wire connections between a platform, preferably a tension leg platform at the sea surface and a seabed frame in deep water having one or more wellheads, where the new and characterizing traits are:

a) at least one shuttle plate with spaced apertures through which apertures pass riser tubes and wires, and b) elevator devices arranged for vertical movements of the shuttle plates, in such a way that the shuttle plates are arranged to be vertically displaced together with a riser tube to guide the riser tube's lower end to the wellhead connectors of the seabed frame.

The invention comprises also a method for setting of riser tubes by means of vertical wire connections between a platform at the sea surface and a seabed frame, for example, a wellhead in deep water, by means of a device as described above, where the new and characterizing steps are:

i) elevating, by means of elevator devices, a shuttle plate to its upper position, ii) lowering of the riser tube's lower leading end through an adjacent aperture of the shuttle plate, iii) lowering by means of the elevator devices the shuttle plate simultaneously with feeding out the riser tube's lower leading end, until the lower leading end of the riser tube reaches into an aperture of an underlying shuttle plate, iv) repeating steps (i) to (iii) with an underlying shuttle plate until the lower leading end of the riser tube reaches the planned depth level, preferably a wellhead of the seabed frame. Other and supplementary traits of the invention are defined in the patent claims.

BRIEF DESCRIPTION OF THE SEVERAL VIEWS OF THE DRAWINGS

The invention is illustrated in the FIGS. 2 to 5 accompanying this application. The Figures have reference numbers corresponding to the description and the patent claims. The Figures shall not limit the scope of the invention, which is only limited by the patent claims.

DETAILED DESCRIPTION OF THE INVENTION

Figure 1:
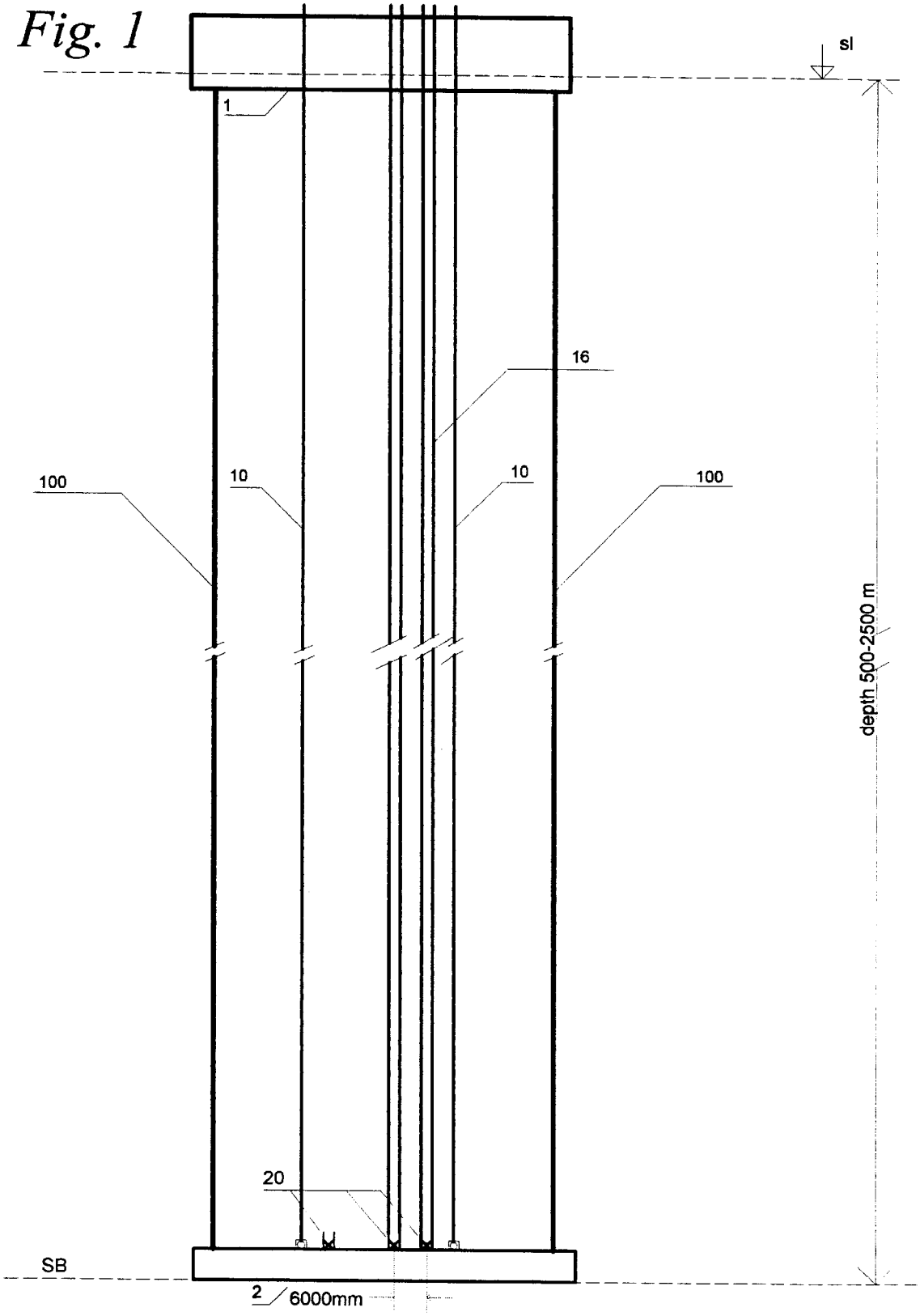
FIG. 1 describes in principle a tension leg platform in deep water, with water depths between approximately 500 meters and 2500 meters.

A riser tube tower shown in FIG. 1 comprises vertical wires 10 connecting a platform, preferably a tension leg platform 1 at the sea surface, and a seabed frame 2 situated in deep water. Tension legs 100 keep the tension leg platform in tensioned connection with an anchoring device at the seabed. The tension legs 100 are, due both to safety precautions and from a practical point of view, not advisably involved in the preferred embodiment of the invention, and they are sketched only in FIG. 1 where the tension leg platform 1 and the seabed frame is sketched somewhat wider than in the further enclosed Figures where tension legs 100 are eliminated from the drawings for clarity.

Figure 2A:
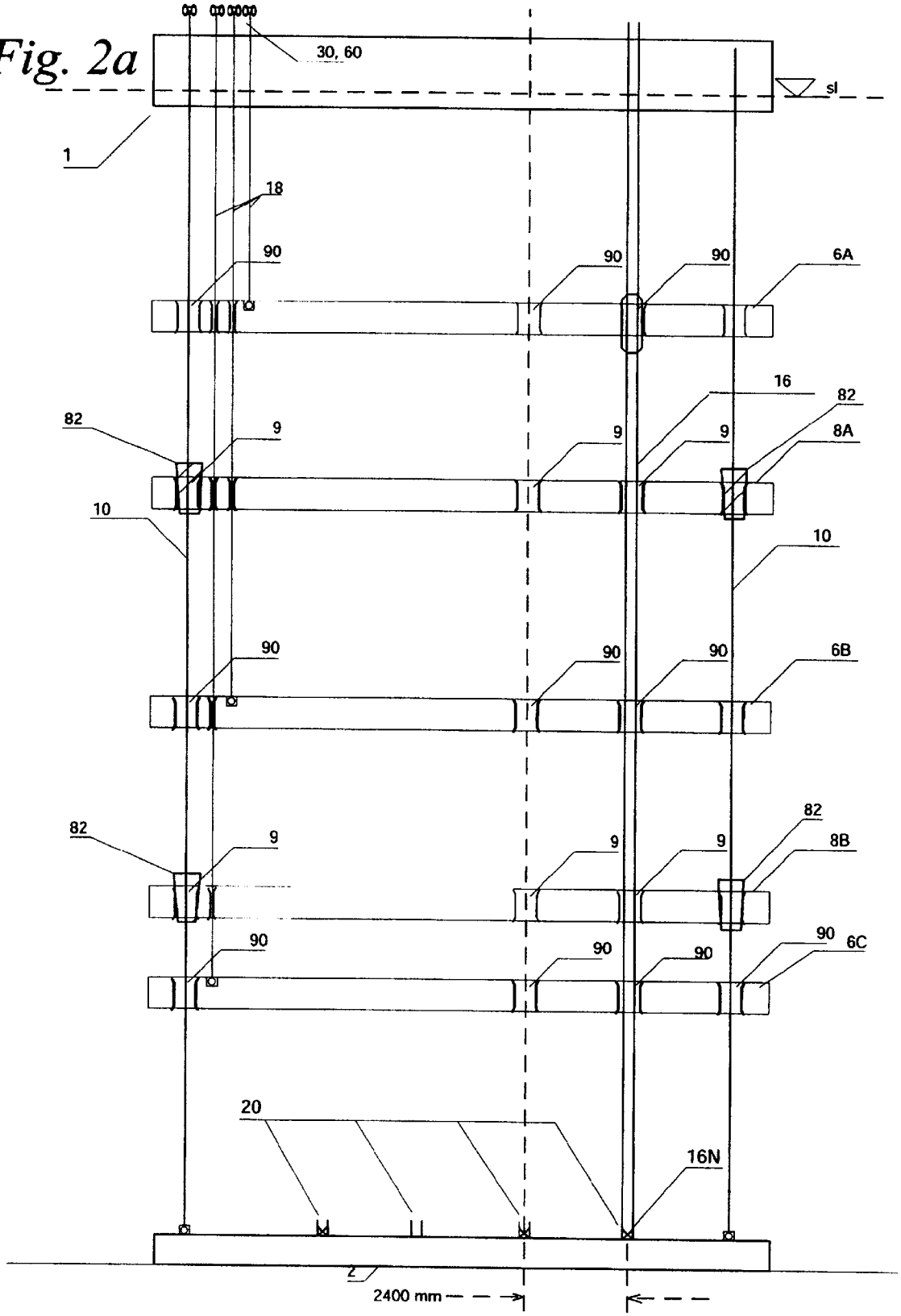
FIGS. 2*a*, 2*b*, . . . , 2*g* illustrate a preferred embodiment of the invention comprised mainly by fixed guide plates and vertically translating or moveable shuttle plates, and illustrate the method according to the invention to set a riser tube from a TLP to an underwater installation.

The seabed frame 2 comprises one or several wellheads 20. The wellheads may be in connection with production wells or production tubes (not shown). Referring to FIG. 2*a*, one or more guide plates 8A, 8B, . . . may be arranged at different levels, and the guide plates are supplied with spaced apertures 9, through which apertures pass riser tubes 16 and wires 10, 18. This principle for separating and tightening up riser tubes is known from the international patent application PCT/N097/00047.

FIG. 2*a* displays some of the new traits of the invention, comprising two especially interrelated traits: a) plates to guide or steer the riser tubes, and b) elevator devices for the plates:

a) comprises at least two shuttle plates 6A, 6B, 6C, . . . arranged in the vertical spaces over and under the guide plates 8A, 8B, . . . . The shuttle plates have spaced apertures 90 corresponding and adjacent to the guide plate apertures 9. The riser tubes 16 and wires 10, 18 pass through the shuttle plate and guide plate apertures.

b) elevator devices 60 arranged for vertical movement of the shuttle plates 6A, 6B, 6C, . . . .

The shuttle plates 6A, 6B, 6C, . . . are arranged to be vertically displaced by the elevator devices 60 together with the riser tubes 16 to guide or steer the lower end 16N of the riser tube 16 through the apertures 9 in the guide plates 8A, 8B and also to the connecting points of the seabed frame 2 and the wellheads 20.

In a preferred embodiment of the invention, the elevator devices 60 comprise winches 30 on the tension leg platform 1 with wires 18 fastened to the respective shuttle plates 6A, 6B, 6C, . . . . The elevator devices may comprise any other mechanisms as automotive climbing devices, rods, et ectera.

Figure 4:
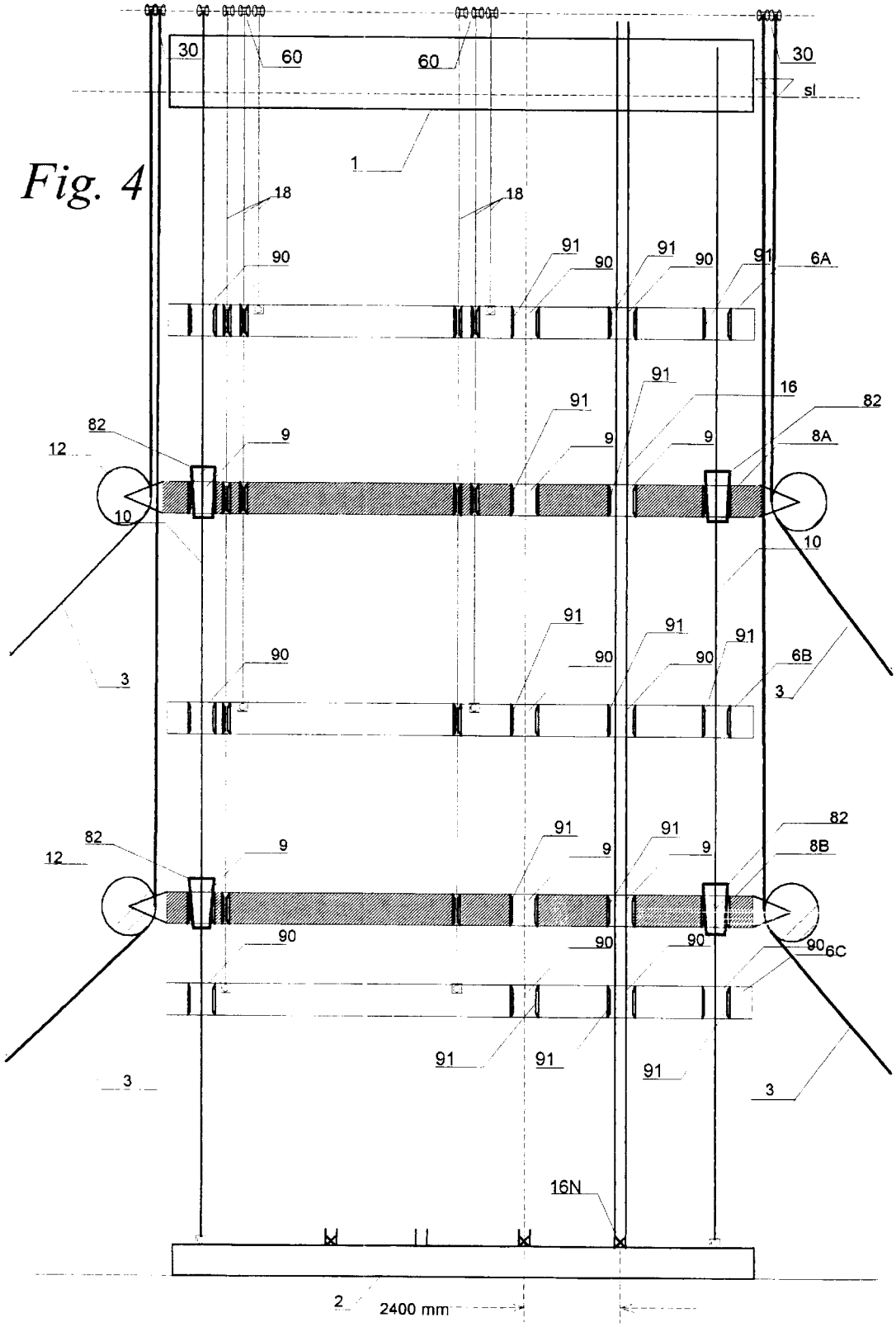
FIG. 4 displays guide wheels for stay wires arranged on each guide plate.

Referring to FIG. 4, to prevent wear of the guide plates, shuttle plates, and wires, the linings of apertures 9 and 90 in the guide plates 8A, 8B, . . . and in the shuttle plates 6A, 6B, 6C, . . . , respectively, are supplied with bushings 91 to protect the guide and shuttle plates and to reduce friction between the walls of apertures 9, 90 and the through running riser tubes 16, tension legs, and wires 10, 18. The guide plates' and the shuttle plates' apertures 9, 90 with bushings 91 must have an inner diameter large enough to let through a wellhead connector mounted on the lower end 16N of the riser tube 16 which is being guided down to the wellhead. To center the riser tubes and to prevent loose play between the riser tubes and respectively the guide plates and the shuttle plates, the riser tubes may be supplied with pipe sleeves (not illustrated) at the corresponding levels of the guide plates when the riser tubes are set down and the wellhead connectors of the riser tubes are connected to the wellheads. Further, tube sleeves (not illustrated) may be mounted on the riser tube 16 by the optimal positions for the shuttle plates in their optimally "parked" positions between the guide plates after the setting of the riser tubes. As an alternative to the tube sleeves, the plates may be supplied with choke devices or blocks (not illustrated) or other kinds of lining arranged to enclose the riser tubes at the apertures.

Referring to FIG. 4, each shuttle plate 6A, 6B, 6C, . . . is in a preferred embodiment hung at its center of gravity by a wire 18. In alternative embodiments, the shuttle plates may be attached to pairs (or triplets, quadruples or more) of wires which thus must be fed out or winched out (or winched in) simultaneously.

The fixed guide plates are supplied with stoppers 82, preferably in the shape of conical elements, arranged in the apertures 9 of the guide plates 8A, 8B, 8C, . . . to lock the guide plates 8A, 8B, 8C, . . . to wires, preferably the guide wires 10, 18. Such stoppers belong to the known art in a variety of embodiments. On installing stay wires to stiffen up or stabilize the whole riser tube tower (as is explained below) the stoppers' vertical forces may be completely or partly replaced by other means, as explained below.

Figure 5:
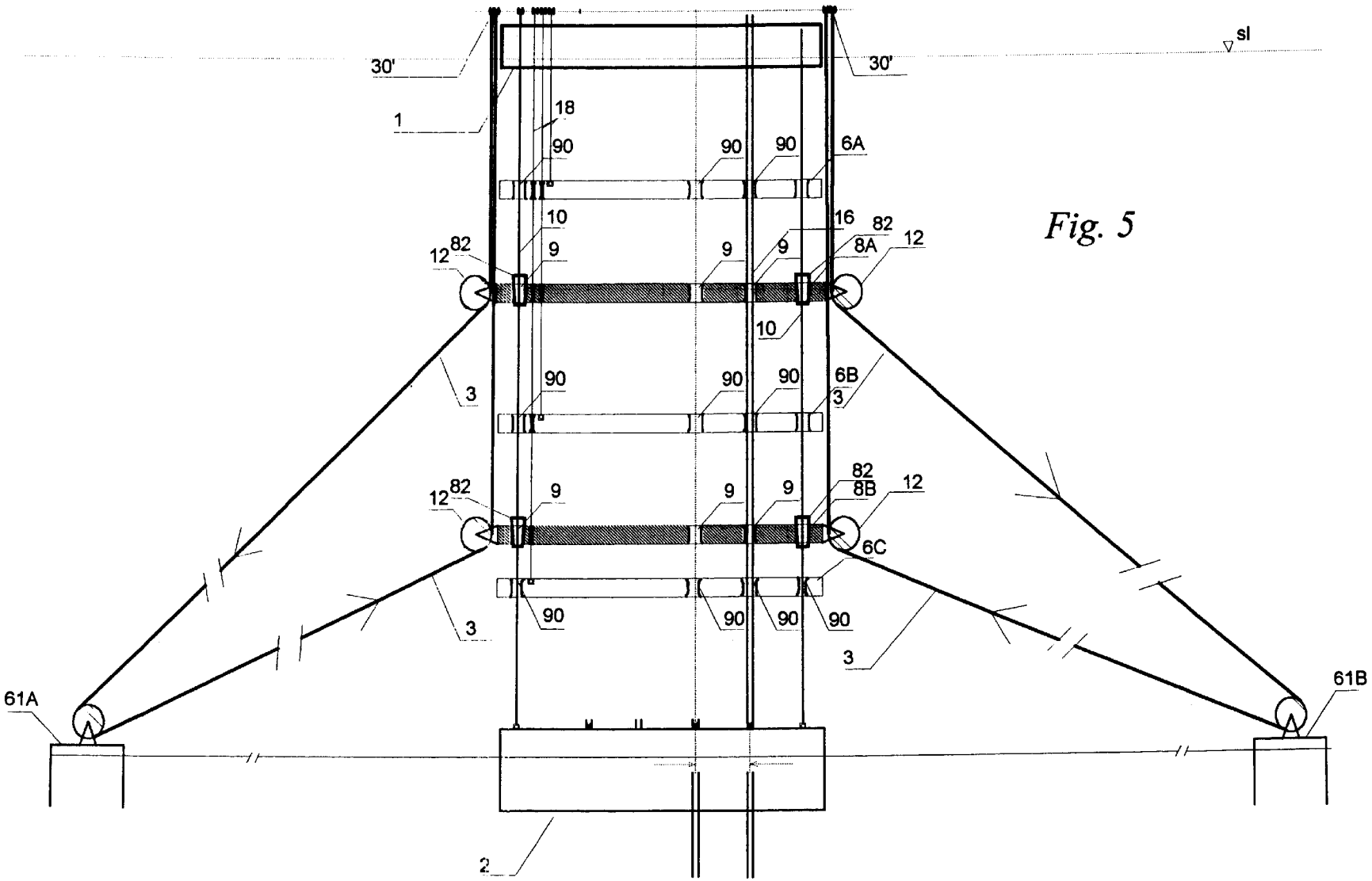
FIG. 5 displays an embodiment of the invention in which the stay wires form a continuous or endless loop.

Referring to FIG. 5, stay wires 3 are in a preferred embodiment arranged between at least one guide plate 8A, 8B, . . . and at least one anchoring 61A, 61B, . . . at a distance outside the seabed frame 2.

FIGS. 4 and 5 display a preferred embodiment with guide wheels 12 arranged on the guide plates 8A, 8B, . . . and on the anchors 61A, 61B, . . . (seen in FIG. 5). The guide wheels are arranged to guide at least one stay wire 3 from winches 30 at the tension leg platform 1 via one guide plate 8A via an anchor 61A, 61B, . . . via preferably another guide plate 8B and back to the tension leg platform 1. With the guide wheels arranged on the guide plates, resultant forces will arise due to the anchor forces pulling obliquely down in one direction and the continuation of the wire pulling in the other direction up to the tension leg platform. This resultant force will have its point of attack in the center of the guide wheel, and have one of its components upward. Thus the anchoring via the guide wheels will have a force component upward on each guide plate.

FIG. 5 shows how the stay wire 3 may provide a continuous or endless loop. A warping or shifting device 30' shifts the stay wire 3 in its lengthwise direction through the whole system of guide wheels 12. A convenient solution is to use on of the winches 30 or another kind of drum for warping or shifting the wire in order to inspect the wire. Thus it is possible to warp or shift the wire along its length at regular time intervals, and in this way distribute the stretching, bending, friction and wear much more evenly over the total length of the wire. This will increase the wire's lifetime. It also contributes to the reliability and safety of the riser tube tower. Additionally the wire may be warped or run through the entire system of guide wheels by the above mentioned warping or shifting device 30' for inspection either regularly by predetermined intervals or whenever the necessity would arise. The inspection would be performed manually/visually or automatically with sensing equipment such as camera, calipers, etc. (not shown) checking the physical condition of the wire while passing the sensor.

FIG. 5 shows a basic embodiment with each single stay wire drawn via guide wheels at two different levels of the riser tube tower. Given this basic solution, it is obvious for a skilled person to arrange guide wheels at guide plates with stays at, for example, three levels of the riser tube tower, and arrange each single wire via each level out to guide wheels on one or several anchoring points at the seabed. An even number of levels (in the riser tube tower) for the guide wheels gives a more economical and power-balanced solution.

Figure 3:
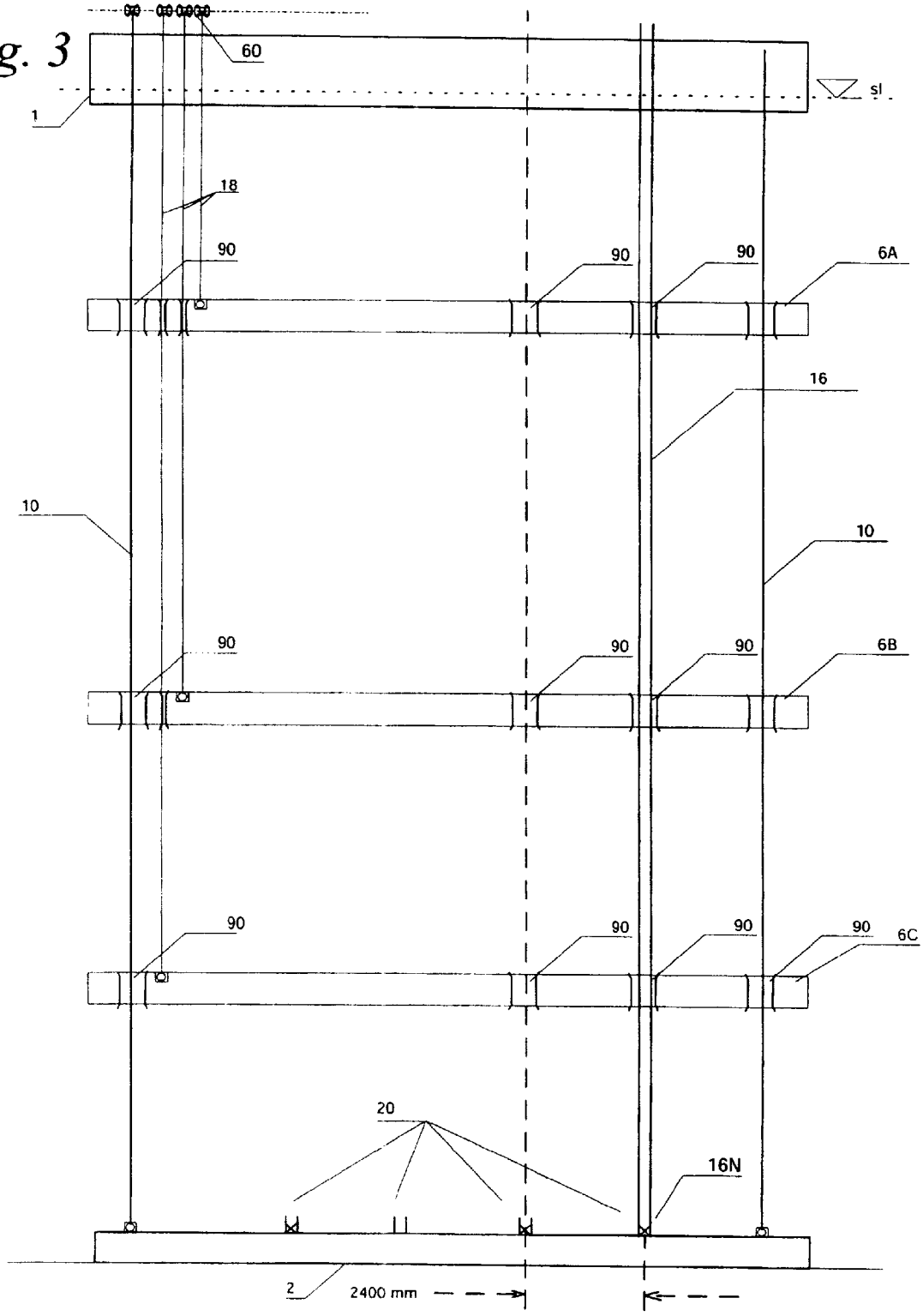
FIG. 3 illustrates a simplified embodiment of the invention, without the fixed guide plates.

A simplified embodiment of the invention is shown in FIG. 3, where the fixed guide plates are omitted. This solution consists of a riser tube tower with vertical wires 10 connecting a platform, preferably a tension leg platform 1 at the sea surface, and a seabed frame 2 situated in deep water, comprising one or more wellheads 20. In this arrangement, compared to the above mentioned arrangement, there is a minimized or reduced number of components in an embodiment of:

a) at least one shuttle plate 6A, 6B, 6C, . . . having spaced apertures 90, through which apertures pass riser tubes 16 and wires 10, 18, and b) elevator devices 60 arranged to perform vertical movements of the shuttle plates 6.

The shuttle plates 6 are vertically displaced by the elevator devices 60 together with a riser tube 16 so as to guide the riser tube's lower end 16N to the connector points of the seabed frame 2.

Otherwise, the riser tube's tower's elevator- and guide mechanism comprises the same details as in the embodiment described above. Stoppers, stay wires and guide wheels may also be arranged on some or all of the shuttle plates in order to take over the role of the fixed guide plates when the riser tube installation process has been performed as explained above.

Figure 2B:
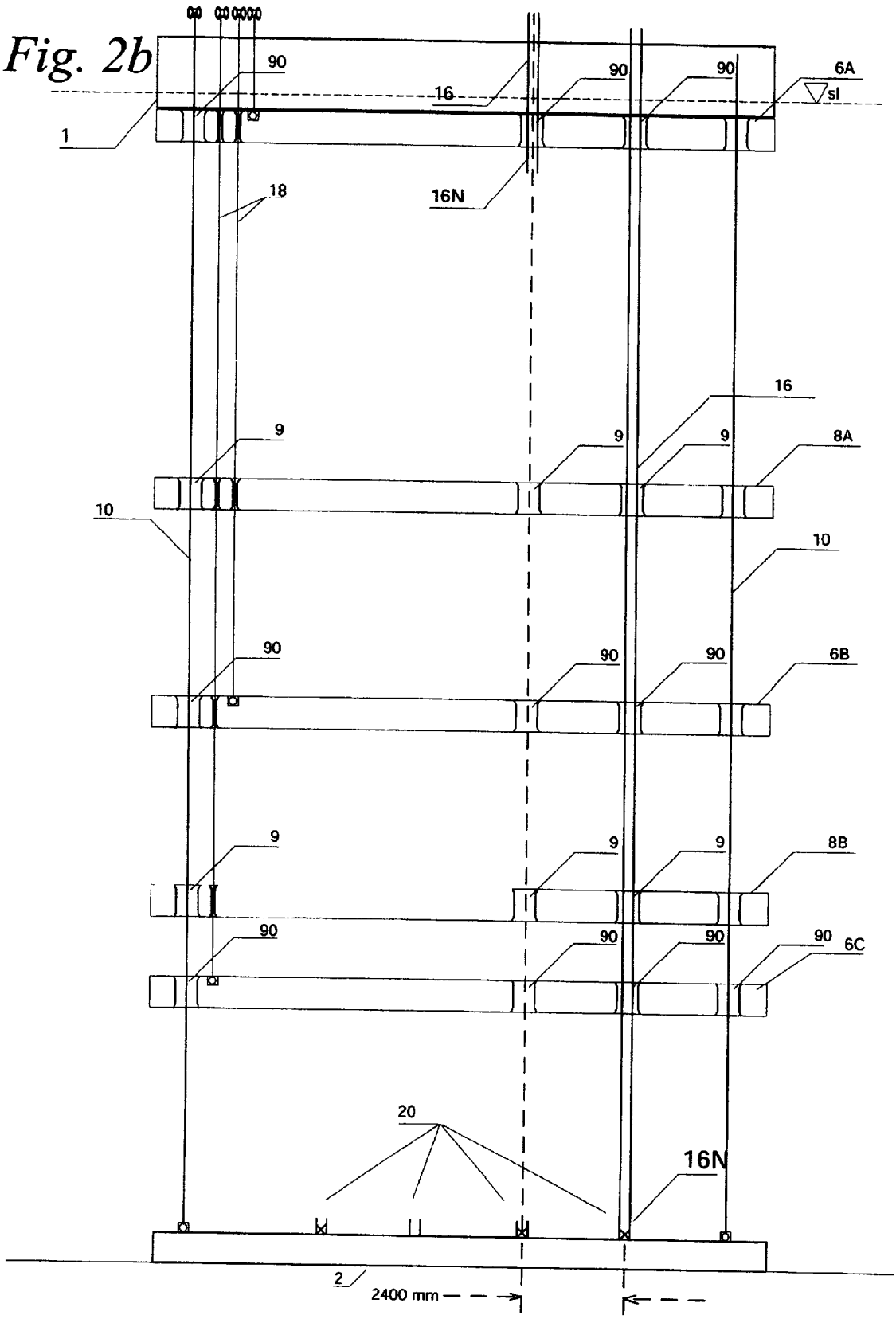
Figure 2C:
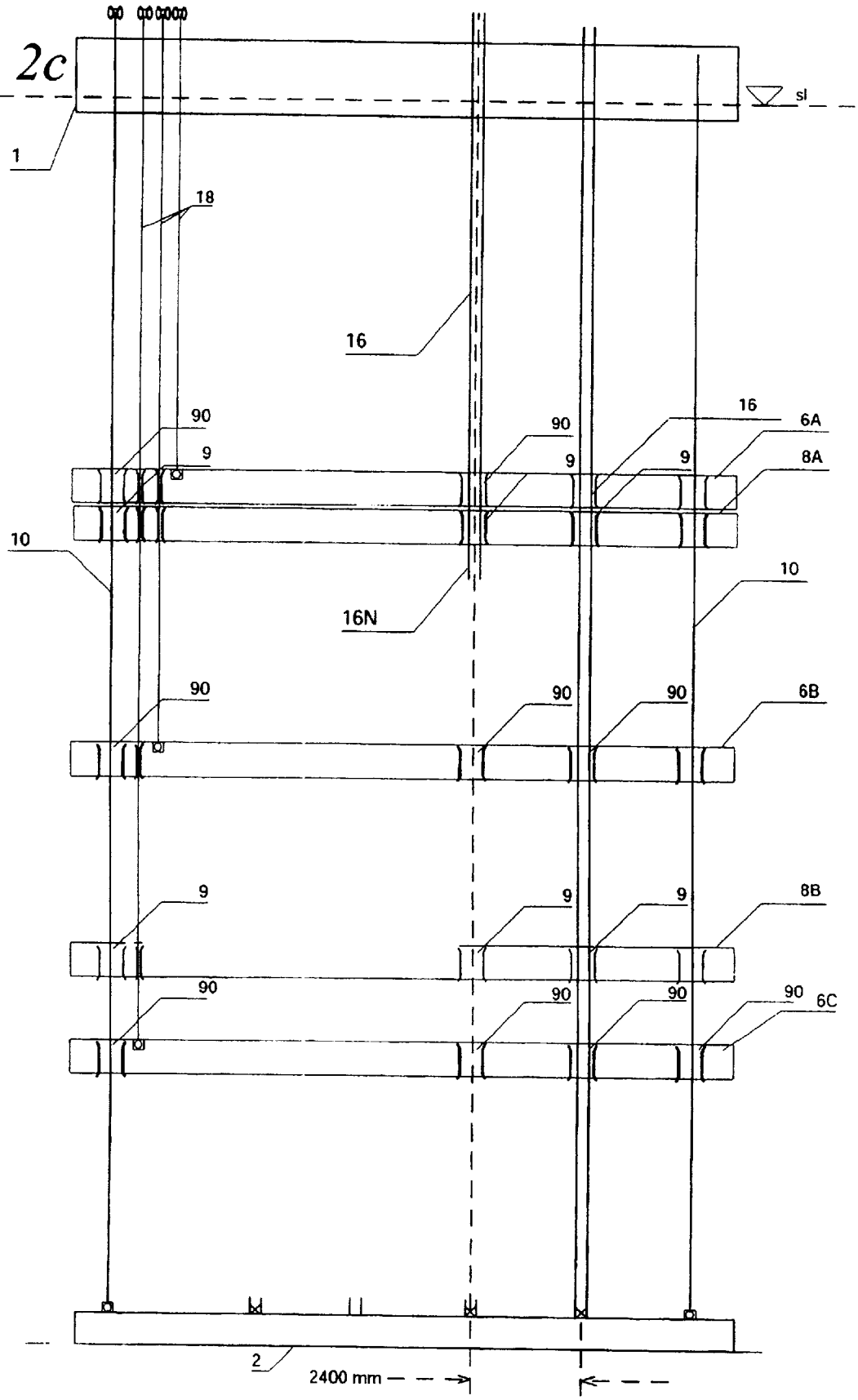
Figure 2D:
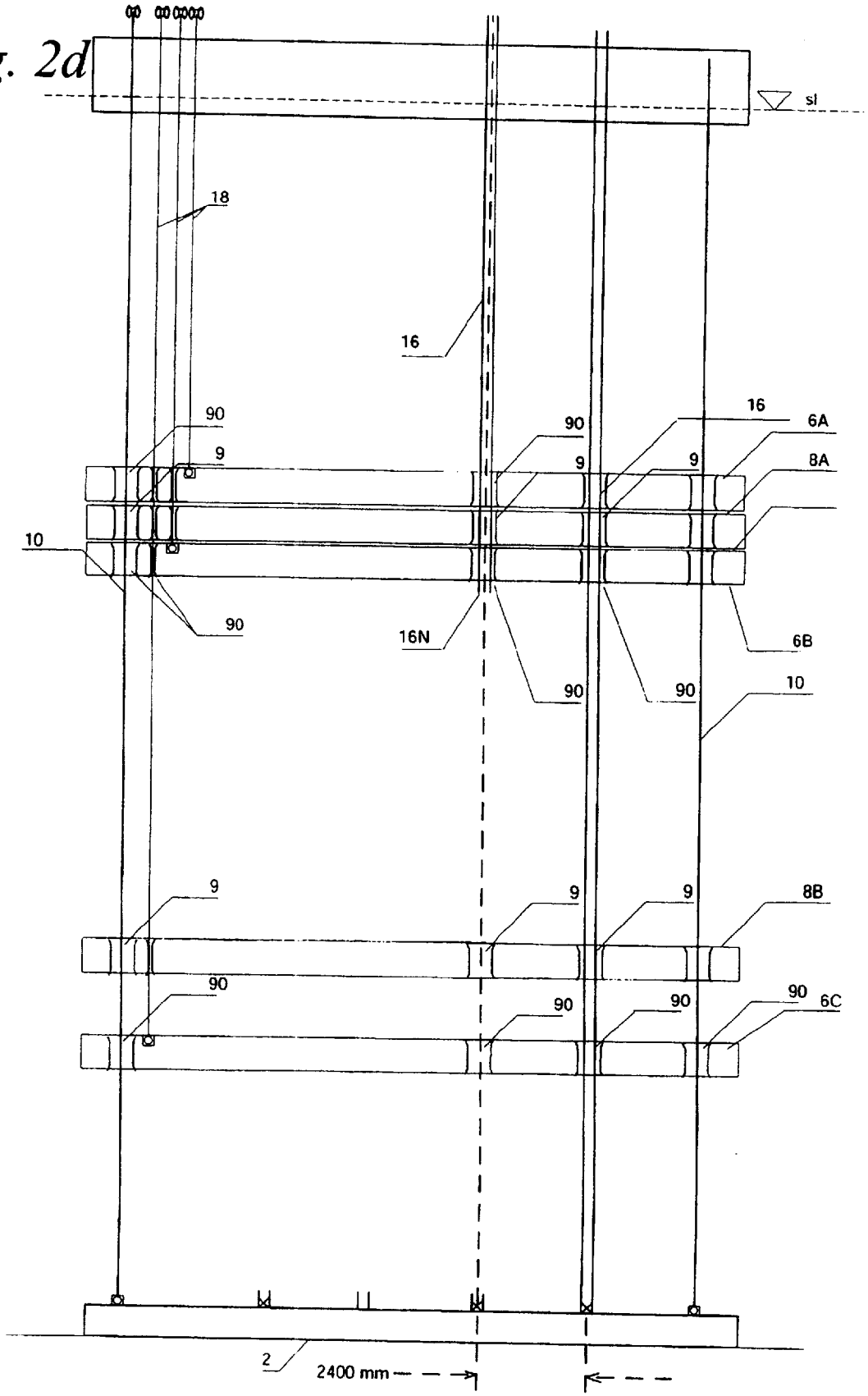
Figure 2E:
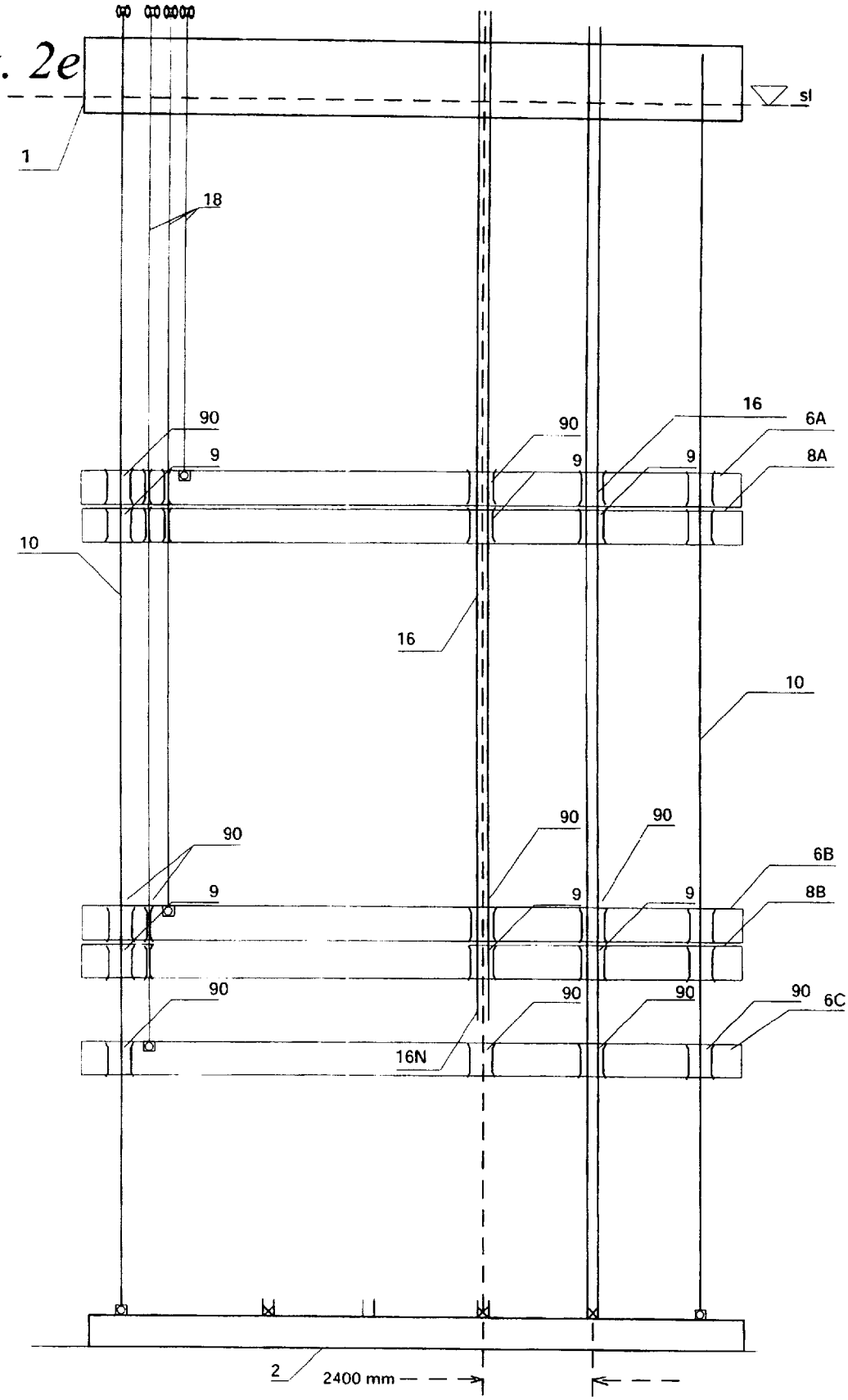
Figure 2F:
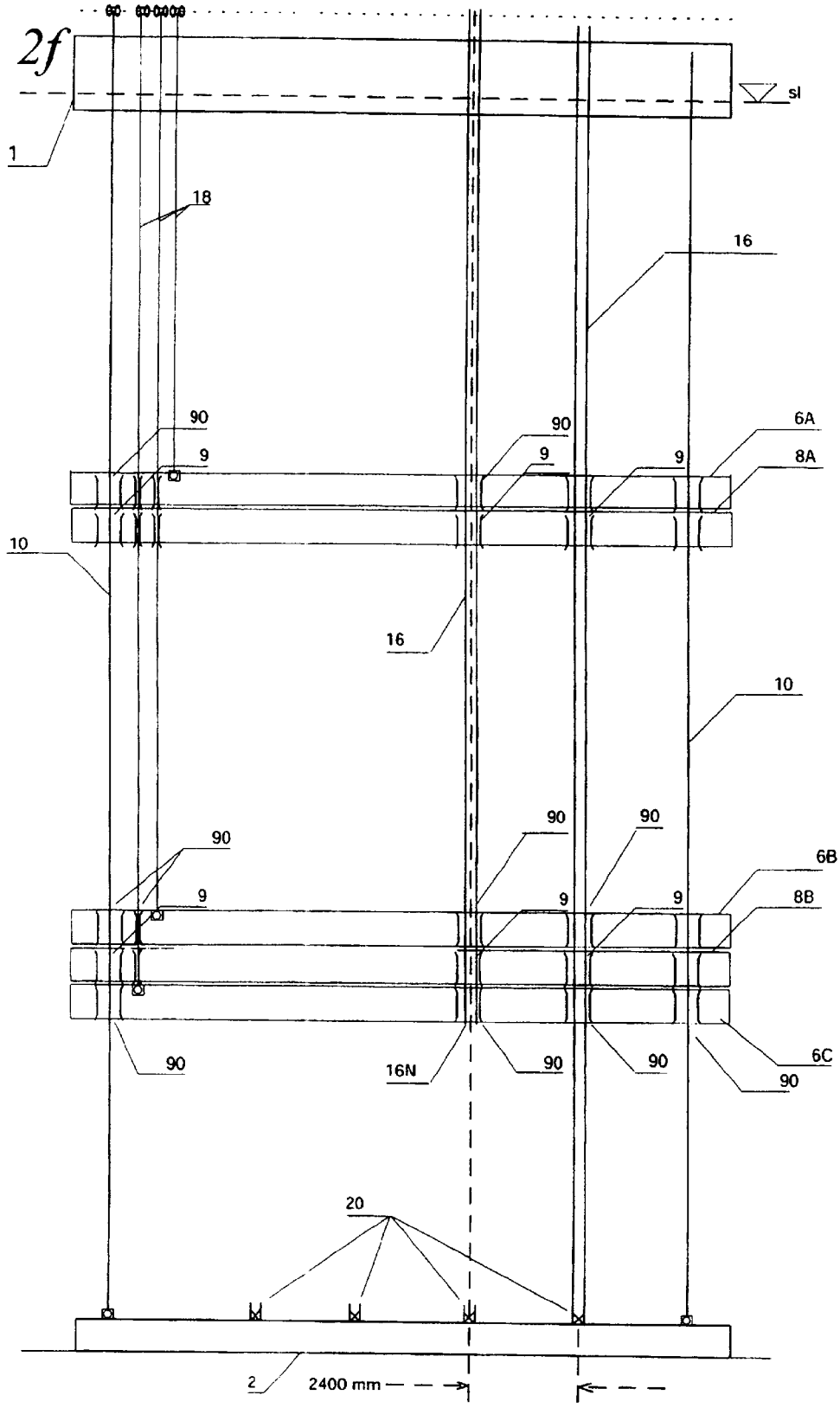
Figure 2G:
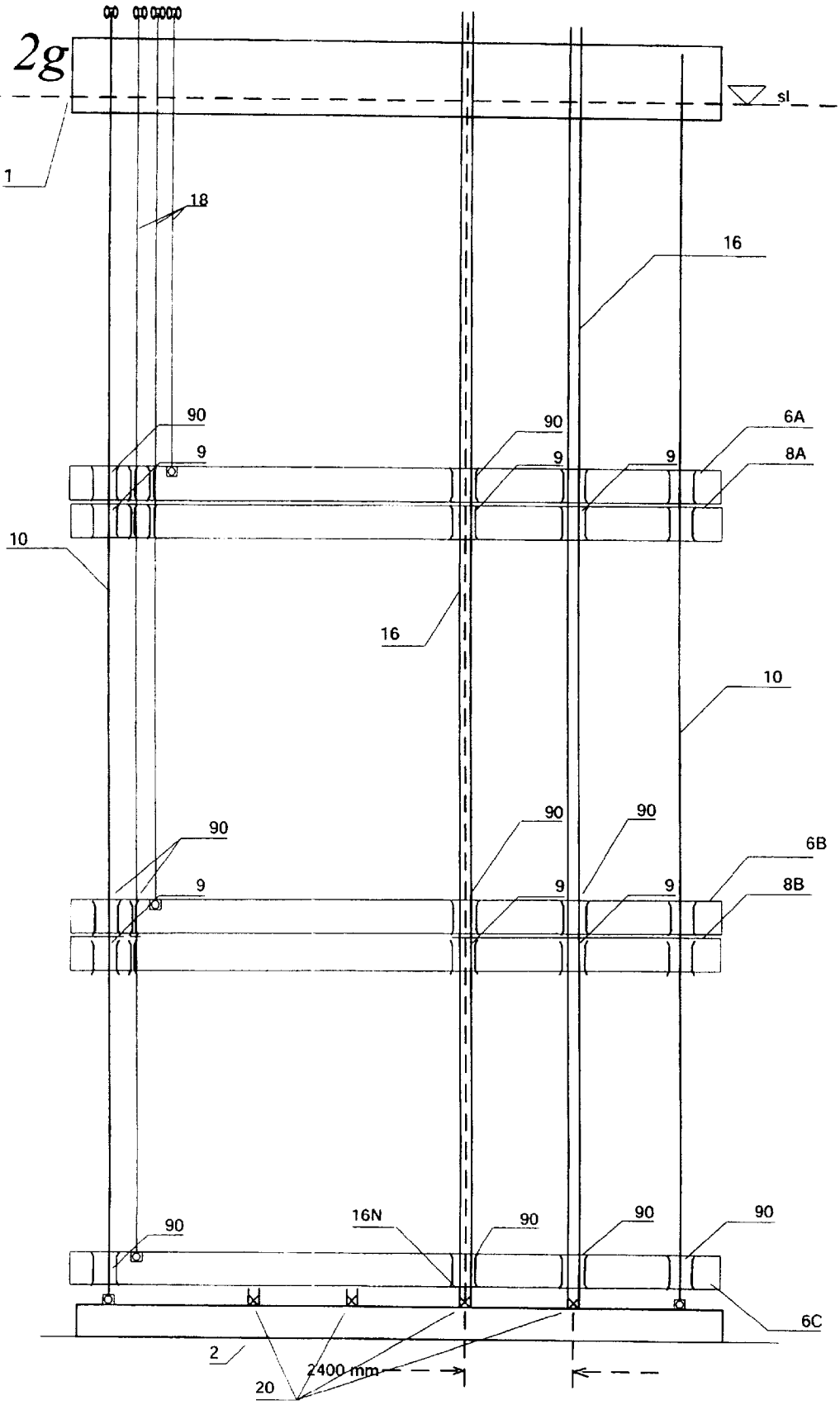

The method according to the invention for setting of risers 16 is shown in FIGS. 2*a* to 2*g*. The method is performed by means of vertical wires 10 connecting a platform 1 at the sea surface with a seabed frame 2, for example a wellhead 20 situated in deep water, by means of a device as described above. The method is performed in a loop of sequences consisting of the below mentioned three steps:

(i) FIGS. 2*a*–2*b*: Elevating, by means of elevator devices 60, a shuttle plate 6A to the shuttle plate's upper position adjacent the TLP 1;

(ii) FIG. 2*b*: Lowering of the lower leading end 16N of the riser tube 16 through an adjacent aperture 90 of the shuttle plate 6A;

(iii) FIG. 2C: Lowering, by means of the elevator devices 60, the shuttle plate 6A together with feeding out the lower leading end 16N of riser tube 16 until the lower leading end 16N reaches into the apertures 9 of an underlying guide plate 8A.

Then steps (i) to (iii) are repeated sequentially with the nearest underlying shuttle plate 6B, 6C, . . . until the lower leading end 16N of riser tube 16 reaches the predetermined depth level, preferably a wellhead 20 at the seabed frame 2.

What is claimed is:

1. A method for lowering a vertically disposed riser tube from a platform at the sea surface to a wellhead on the seabed, the method comprising:

providing at least one horizontally disposed shuttle plate between the platform and the seabed, the shuttle plate having at least one aperture therein;

elevating the shuttle plate to a position near the platform;

lowering the leading end of the riser tube through an adjacent aperture in the shuttle plate; and lowering the shuttle plate and riser tube together until the leading end of the riser tube reaches the wellhead on the seabed.

2. A riser tube tower for stabilizing riser tubes extending from respective wellheads associated with a seabed frame on the seabed to a platform at the sea surface, the tower comprising:

vertically disposed wires connecting the platform to the seabed frame;

at least one horizontally disposed guide plate located between the platform and the seabed frame, the riser tubes and wires passing through respective apertures in the guide plates;

a horizontally disposed shuttle plate located above and below each guide plate, the riser tubes and wires passing through respective apertures in each shuttle plate, the apertures in the shuttle plates being aligned with respective apertures in the guide plates;

at least one elevator device associated with the platform for lowering each shuttle plate together with the riser tubes so that the lower ends of the riser tubes are guided to respective apertures in the guide plates and to respective wellheads on the seabed; and bushings disposed in the apertures of the guide plates and the shuttle plates for protecting the guide plates and shuttle plates from the riser tubes and wires, and for reducing friction therebetween.

3. A riser tube tower for stabilizing riser tubes extending from respective wellheads associated with a seabed frame on the seabed to a platform at the sea surface, the tower comprising:

vertically disposed wires connecting the platform to the seabed frame;

at least one horizontally disposed guide plate located between the platform and the seabed frame, the riser tubes and wires passing through respective apertures in the guide plates;

a horizontally disposed shuttle plate located above and below each guide plate, the riser tubes and wires passing through respective apertures in each shuttle plate, the apertures in the shuttle plates being aligned with respective apertures in the guide plates;

at least one elevator device associated with the platform for lowering each shuttle plate together with the riser tubes so that the lower ends of the riser tubes are guided to respective apertures in the guide plates and to respective wellheads on the seabed;

stay wires connecting at least one guide plate to at least one seabed anchor located away from the seabed frame; and guide wheels disposed on the guide plates and on the anchors for guiding the stay wires to and from the guide plates and the anchors.

4. A riser tube tower as recited in claim 3, further including a winch disposed on the platform, and wherein the guide wheels guide at least one stay wire from the winch to a first guide plate and thence to an anchor and thence to a second guide plate and thence to the platform.

5. A riser tube tower as recited in claim 4, wherein the stay wire forms a continuous and endless loop.

6. A riser tube tower as recited in claim 5, further including a shifting device associated with the stay wire for moving the stay wire longitudinally over each of the guide wheels.

7. A riser tube tower for stabilizing riser tubes extending from respective wellheads associated with a seabed frame on the seabed to a platform at the sea surface, wherein anchors are fixed to the seabed at locations away from the seabed frame, the tower comprising:

vertically disposed wires connecting the platform to the seabed frame;

at least one horizontally disposed guide plate located between the platform and the seabed frame, the riser tubes and wires passing through respective apertures in the guide plates;

a horizontally disposed shuttle plate located above and below each guide plate, the riser tubes and wires passing through respective apertures in each shuttle plate, the apertures in the shuttle plates being aligned with respective apertures in the guide plates;

at least one elevator device associated with the platform for lowering each shuttle plate together with the riser tubes so that the lower ends of the riser tubes are guided to respective apertures in the guide plates and to respective wellheads on the seabed;

stoppers disposed in the guide plate apertures for locking the guide plate to the wires passing through its apertures; and stay wires extending between at least one level of the riser tube tower and respective anchors on the seabed, wherein each stay wire forms a continuous and endless loop by way of at least two of the guide plates and at least one anchor.

8. A riser tube tower as recited in claim 7, further including guide wheels disposed on the guide plates and on the anchors for guiding the stay wires to and from the guide plates and the anchors.

9. A riser tube tower as recited in claim 8, further including a winch on the platform, the winch associated with the stay wires for tightening, slackening, or moving the stay wires longitudinally over the guide wheels.

10. A riser tube tower as recited in claim 9, wherein the path of at least one of the stay wires runs from the winch to a first guide plate and thence to an anchor and thence to a second guide plate and thence to the platform.

11. A riser tube tower for stabilizing riser tubes extending from respective wellheads associated with a seabed frame on the seabed to a platform at the sea surface, wherein anchors are fixed to the seabed at locations away from the seabed frame, the tower comprising:

vertically disposed wires connecting the platform to the seabed frame;

at least one horizontally disposed guide plate located between the platform and the seabed frame, the riser tubes and wires passing through respective apertures in the guide plates;

a horizontally disposed shuttle plate located above and below each guide plate, the riser tubes and wires passing through respective apertures in each shuttle plate, the apertures in the shuttle plates being aligned with respective apertures in the guide plates;

at least one elevator device associated with the platform for lowering each shuttle plate together with the riser tubes so that the lower ends of the riser tubes are guided to respective apertures in the guide plates and to respective wellheads on the seabed;

stoppers disposed in the guide plate apertures for locking the guide plate to the wires passing through its apertures;

stay wires extending between at least one level of the riser tube tower and respective anchors on the seabed, and bushings disposed in the apertures of the guide plates and the shuttle plates for protecting the guide plates and shuttle plates from the riser tubes and wires, and for reducing friction therebetween.

* * * * *